US010417987B2

(12) United States Patent
Xing et al.

(10) Patent No.: US 10,417,987 B2
(45) Date of Patent: Sep. 17, 2019

(54) DATA DRIVER AND DISPLAY PANEL

(71) Applicant: Wuhan China Star Optoelectronics Technology Co., Ltd., Wuhan, Hubei (CN)

(72) Inventors: Zhenzhou Xing, Guangdong (CN); Chun-hung Huang, Guangdong (CN)

(73) Assignee: Wuhan China Star Optoelectronics Technology Co., Ltd., Wuhan, Hubei (CN)

( * ) Notice: Subject to any disclaimer, the term of this patent is extended or adjusted under 35 U.S.C. 154(b) by 173 days.

(21) Appl. No.: 15/544,002

(22) PCT Filed: May 26, 2017

(86) PCT No.: PCT/CN2017/086186

§ 371 (c)(1),
(2) Date: Jul. 15, 2017

(87) PCT Pub. No.: WO2018/196085

PCT Pub. Date: Nov. 1, 2018

(65) Prior Publication Data

US 2018/0336860 A1 Nov. 22, 2018

(30) Foreign Application Priority Data

Apr. 27, 2017 (CN) ..... 2017 1 0300592

(51) Int. Cl.
*G09G 3/36* (2006.01)

(52) U.S. Cl.
CPC ..... *G09G 3/3688* (2013.01); *G09G 3/3677* (2013.01); *G09G 2300/0426* (2013.01);
(Continued)

(58) Field of Classification Search
CPC ..... G09G 3/3688; G09G 3/3677; G09G 2300/0426; G09G 2310/027;
(Continued)

(56) References Cited

U.S. PATENT DOCUMENTS

2007/0120810 A1* 5/2007 You ..... G09G 3/3666 345/103
2010/0164924 A1 7/2010 Seo
(Continued)

FOREIGN PATENT DOCUMENTS

CN 101008758 A 8/2007
CN 101487962 A 7/2009
(Continued)

OTHER PUBLICATIONS

First Office Action of 2017103005922.

*Primary Examiner* — Lunyi Lao
*Assistant Examiner* — Jarurat Suteerawongsa
(74) *Attorney, Agent, or Firm* — Andrew C. Cheng

(57) ABSTRACT

A data driver and display panel are disclosed. The data driver is applicable to providing image data to be displayed to a plurality of data lines. The data driver includes: a data processing unit, a driving unit, and at least two sets of data outputs. The data processing unit is configured to receive and store one frame of image data to be displayed. The driving unit is to output at least two sets of data voltages having different driving capacities according to the image data. Each of the at least two sets of data outputs includes a plurality of data outputs, and each set is connected to pixels in two areas with a different distance from the data driver. The driving unit provides the at least two sets of data voltages having different driving capabilities to the at least two sets of data outputs.

15 Claims, 9 Drawing Sheets

(52) U.S. Cl.
CPC ..... *G09G 2310/027* (2013.01); *G09G 2310/0286* (2013.01); *G09G 2310/0289* (2013.01); *G09G 2310/0291* (2013.01); *G09G 2320/0223* (2013.01); *G09G 2320/0242* (2013.01)

(58) Field of Classification Search
CPC ... G09G 2310/0286; G09G 2310/0289; G09G 2310/0291; G09G 2320/0223; G09G 2320/0242; G09G 3/36
See application file for complete search history.

(56) References Cited

U.S. PATENT DOCUMENTS

| | | | | |
|---|---|---|---|---|
| 2012/0050348 | A1 | 3/2012 | Kurokawa | |
| 2015/0279297 | A1* | 10/2015 | Nakano | G06F 3/041 345/173 |
| 2016/0078841 | A1 | 3/2016 | Park | |
| 2016/0104415 | A1* | 4/2016 | Yeo | G09G 3/3685 345/212 |
| 2016/0358574 | A1* | 12/2016 | Hohjoh | G09G 3/3614 |

FOREIGN PATENT DOCUMENTS

| | | | |
|---|---|---|---|
| CN | 103280195 | A | 9/2013 |
| CN | 104575360 | A | 4/2015 |
| CN | 104834138 | A | 8/2015 |
| CN | 104835472 | A | 8/2015 |
| CN | 106257580 | A | 12/2016 |
| KR | 20130027920 | A | 3/2013 |

* cited by examiner

DATA DRIVER AND DISPLAY PANEL

CROSS REFERENCE TO RELATED APPLICATIONS

This application claims the priority of Chinese Patent Application No. 201710300592.2, entitled "Data Driver and Display Panel", filed on Apr. 27, 2017, the disclosure of which is incorporated herein by reference in its entirety.

BACKGROUND OF THE INVENTION

1. Field of the Invention

The present invention relates to the field of display, and in particular to the field of data driver and display panel.

2. The Related Arts

The display panel has been widely applied to display devices of various fields, such as, computers, mobile phone and TV.

The display panel uses the data driver to supply the image data signal to the pixel unit in the display panel through the data line, and the scan driver controls the corresponding pixel through the scan line when to receive the data signal so as to display the image signal to obtain the image to be displayed. However, in the actual use, the display panel often shows inconsistent image display at the two ends on the display panel; that is, the image displayed on the opposite ends of the display panel will show color differences, resulting in poor image display performance.

SUMMARY OF THE INVENTION

To solve the above problem, the present invention provides a data driver with better performance of display driving result.

Furthermore, the present invention also provides a display panel with the above data driver.

The present invention provides a data driver, applicable to providing image data to be displayed to a plurality of data lines. The data driver comprises: a data processing unit, a driving unit, and at least two sets of data outputs. The data processing unit is configured to receive and store one frame of image data to be displayed. The driving unit is to output at least two sets of data voltages having different driving capacities according to the image data. Each of the at least two sets of data outputs comprises a plurality of data outputs, and each set is connected to pixels in two areas with a different distance from the data driver. The driving unit provides the at least two sets of data voltages having different driving capabilities to the at least two sets of data outputs.

A display panel comprises: an active area and a plurality of data lines arranged with a distance apart along a first direction. The active area extends in a plane along mutually perpendicular first and second directions, and the active area defines at least two active sub-areas in the second direction. The data lines extend along the second direction and are disposed independently at the at least two active sub-areas. The data driver is provided at one end of the data lines in the second direction for providing a data voltage for image display for the data lines, and the at least two active sub-areas and the data driver are spaced apart with different distances.

Compared with the prior art, the data driver respectively supplies the data voltages having different driving capabilities so that the pixels of the display panel with different distance from the data driver can obtain the data voltage with corresponding driving capability; thus, the display panel can display the consistently and uniformly to achieve better display result.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort.

DETAILED DESCRIPTION OF THE PREFERRED EMBODIMENTS

To further explain the technical means and effect of the present invention, the following refers to embodiments and drawings for detailed description. Apparently, the described embodiments are merely some embodiments of the present invention, instead of all embodiments. All other embodiments based on embodiments in the present invention and obtained by those skilled in the art without departing from the creative work of the present invention are within the scope of the present invention.

Figure 1:
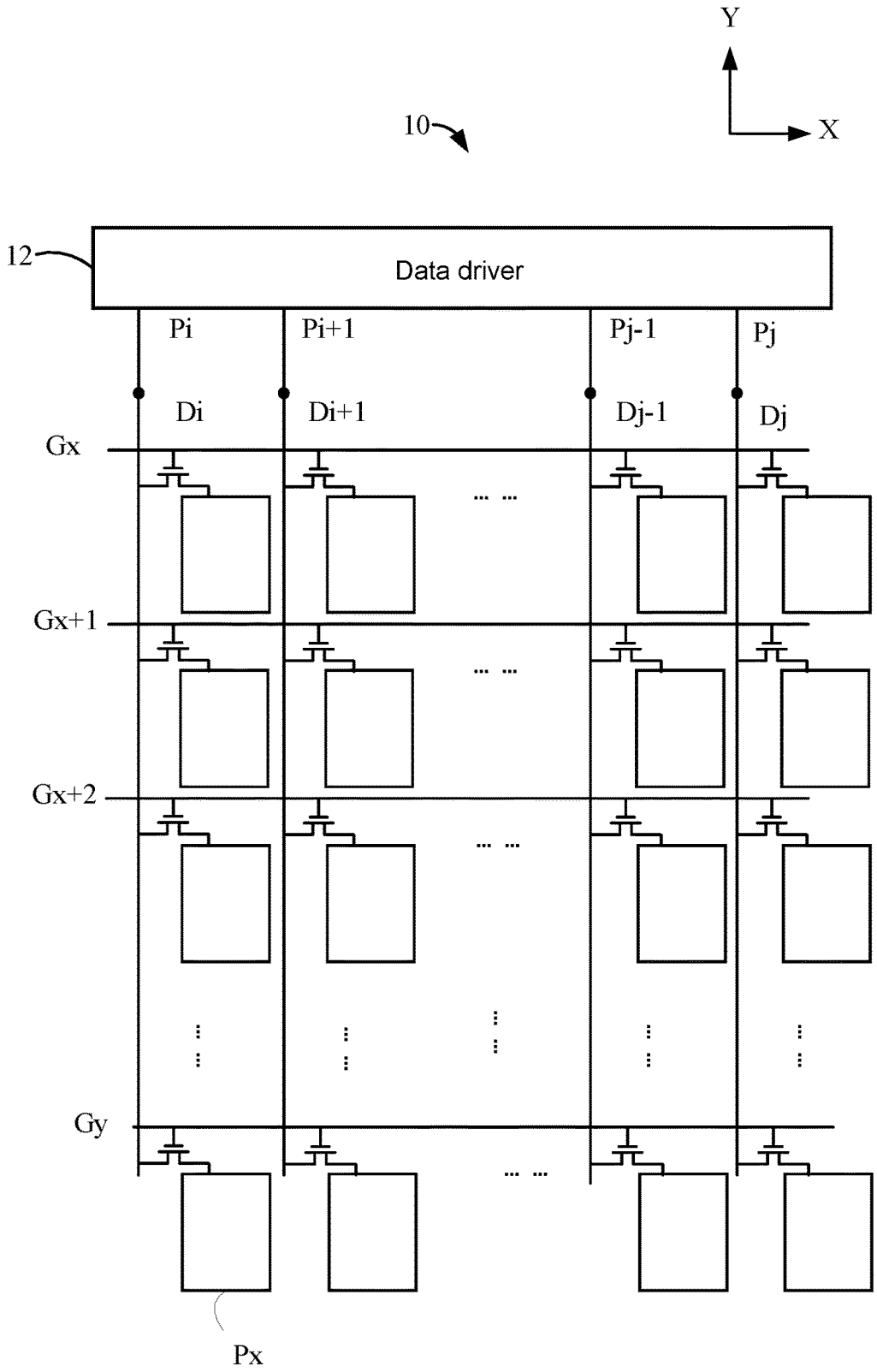
FIG. 1 is a schematic view showing the routing and connection of a part of pixels of the display panel of the present invention.

Refer to FIG. 1. FIG. 1 is a schematic view showing the routing and connection of a part of pixels of the display panel 10 of the present invention. For description, FIG. 1 only shows the routing and connection of a part of pixels.

Specifically, a plurality of data lines Di-Dj are arranged in parallel with each other with a predetermined distance apart and mutually insulated along a first direction X. The plurality of scan lines Gx-Gy are arranged in parallel with each other with a predetermined distance apart and mutually insulated along a second direction Y. Wherein the first direction X and the second direction Y are perpendicular to each other, and $1 \leq i < j$, $1 \leq x < y$, i, j, x and y are natural numbers. The plurality of data lines Di-Dj and the plurality of scan lines Gx-Gy form an array region in which the pixels Px are located in the array region and are electrically connected to the corresponding data lines and scan lines, respectively. Wherein, the first direction X and the second direction Y are perpendicular to each other.

The data driver 12 is disposed at one end of the plurality of data lines Di-Dj, wherein the data driver 12 comprises a plurality of data outputs Pi, with each data output Pi correspondingly connected to a data line Di, for outputting a data signal to the corresponding data line Di.

Correspondingly, the scan driver (not shown) is disposed at one end of the plurality of scan lines Gxi-Gy, wherein the scan driver comprises a plurality of scan outputs, with each scan output correspondingly connected to a scan line Gx, for outputting a data signal to the corresponding scan line Gx.

When the display panel 10 performs image display, the scan driver sequentially transmits the scan signals to the scan lines Gx, Gx+1, . . . Gy, along the second direction Y, that is, scanning sequentially; in the mean time, when the scan driver provides a scan signal to one of the scan lines Gx, the data driver 12 simultaneously provides data lines Di, Di+1, . . . , Dj with a data signal of the image to be displayed. Thus, the data line and the scan line must cooperate to load the image signal into the pixel electrode of the pixel Px. The pixel electrode cooperates with a common voltage to generate an electric field to drive the liquid crystal (LC) molecules to produce a corresponding rotation angle, thereby achieving displaying the image signal.

Figure 2:
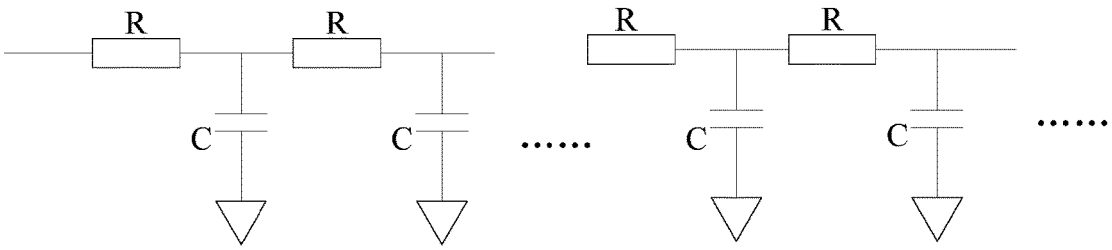
FIG. 2 is a schematic view showing the equivalent circuit connection between any data line and a column of pixels.

Refer to FIG. 2. FIG. 2 is a schematic view showing the equivalent circuit connection between any data line Di and a column of pixels Px.

Figure 3:
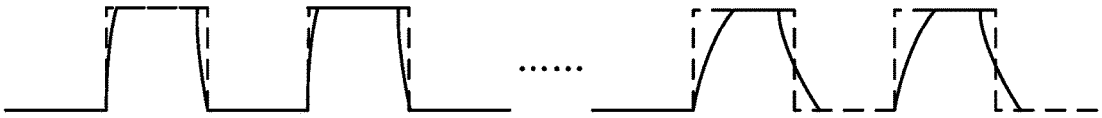
FIG. 3 is a schematic view showing the waveform of a data line of FIG. 1 after loading in data signal.

Refer to both FIG. 1 and FIG. 2. Each data line Di is connected to a plurality of pixels Px in a column; i.e., the data line Di simultaneously connecting a plurality of pixels Px in the i-th column. The connections between the data line Di and the plurality of pixels Px in ah column is equivalent to a plurality of serially connected resistor-capacitor (RC) circuit, as shown in FIG. 3. FIG. 3 is a schematic view showing the waveform of a data line of FIG. 1 after loading in data signal. The dash line in FIG. 3 is the original waveform of the data signal Sdi outputted from the output of the data driver 12, and the solid line is the waveform of the data signal Sdi after distorted during transmission in the data line.

As shown in FIG. 3, as the distance from the data output Pi of the data driver 12 increase, the effect of the RC circuit on the data signal Sdi increases. Because of more stages of RC circuit affecting, the difference between the data signal Sdi and the ideal waveform (i.e., the data signal Sdi outputted by the data output Pi of the data driver 12) also increases; that is, the delay and distortion of the data signal Sdi is more serious as the distance farther away from the output of the data driver 12. This is the cause of non-uniform display and distorted display.

Figure 4:
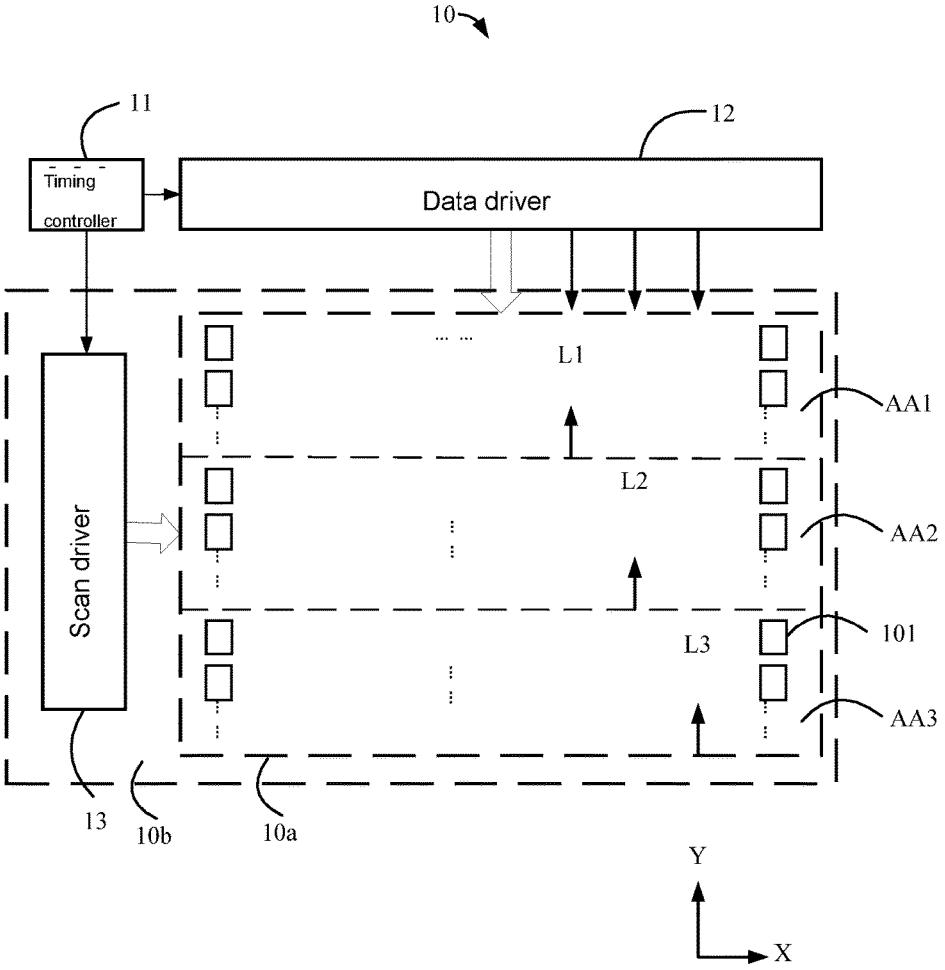
FIG. 4 is a schematic view showing the planar structure of a display device of the present invention.

Therefore, refer to FIG. 4. FIG. 4 is a schematic view showing the planar structure of a display device of the present invention.

As shown in FIG. 4, the display panel 10 comprises an active area 10*a* and a non-active area 10*b*; wherein, the active area 10*a* is disposed with pixels 101 for displaying image, and the non-active area 10*b* surrounds the active area 10*a*, and is disposed with connection wires and drivers for image display.

The display panel 10 comprises a timing control circuit 11, a data driver 12, and a scan driver 13; wherein, the scan driver 13 is disposed at the non-active area 10*b* on a side of the active area 10*a* along the first direction X; and the data driver 12 is disposed at the non-active area 10*b* on a side of the active area 10*a* along the second direction Y. The timing control circuit 11 can be disposed at the non-active area 10*b* of the display panel 10 or at other circuit board independent of the display panel 10.

The data driver 12 is for providing image data to be displayed to the pixels 101 in the active area 10*a*, and uses the plurality of data lines 120 to transmit in a form of data voltage to the pixels 101. The scan driver 13 is electrically connected to the plurality of scan lines 130, for controlling through the plurality of scan lines 130 the pixels 101 when to receive the image data for image display. The timing control circuit 11 is electrically connected to the data driver 12 and scan driver 13 respectively, for controlling the operation timing of the data driver 12 and the scan driver 13, i.e., outputting corresponding timing control signals to the data driver 12 and the scan driver 13.

Moreover, the active area 10*a* is divided into three areas along the second direction Y the three areas are defined as a first active area AA1, a second active area AA2, and a third active area AA3. The first active area AA1 is spaced apart from the data driver 12 with a first distance L1, the second active area AA2 is spaced apart from the data driver 12 with a second distance L2, and the third active area AA3 is spaced apart from the data driver 12 with a third distance L3. The first distance L1 is less than the second distance L2, and the second distance L2 is less than the third distance L3. In other words, the distance from the data driver 12 in the second distance Y increases from the first active area AA1, the second active area AA2 to the third active area AA3.

The first active area AA1, the second active area AA2 and the third active area AA3 mutually independently obtain the data voltage of the image signal from the data driver 12, i.e., the first active area AA1, the second active area AA2 and the third active area AA3 mutually independently obtain data voltage from the data output Pi of the data driver 12. In other words, the data voltage outputted from the data driver 12 is independently provided to the first active area AA1, the second active area AA2 and the third active area AA3 so that the data voltage does not need to propagate from the pixels 101 closer to the data driver 12 to the pixels 101 farther from the data driver 12.

Because the first active area AA1, the second active area AA2 and the third active area AA3 mutually independently obtain data voltage from the data driver 12, the data voltage received by the three areas will be under the same effect of the RC circuit so that the pixels 101 in the entire active area 10*a* have basically the same data voltage, and leading to a more uniform image display result. As such, the present invention can effectively prevent the data voltage on the data line affected by the RC circuit along the propagation from the pixel 101 close to the data driver 12 to the father pixel 101 to aggregate the distortion.

It should be noted that, in the present embodiment, the display panel 10 is a liquid crystal display (LCD), and each pixel 101 comprises at least a thin film transistor (TFT) as a switch. Therefore, the TFT has a gate electrically connected to the scan line 130, and a source electrically connected to the data line 120. Thus, the data line 120 is also called source line and the scan line 130 is also called gate line. Correspondingly, the data driver 12 is called source driver, and the scan driver 13 is also called gate driver.

It should be understood that the display panel 10 is applied to a display device 100. The display device 100 further comprises other auxiliary circuits to complete image display, such as, graphics processing unit (GPU), power supply circuit, and so on, and the details will not be repeated in the present embodiment.

Figure 5:
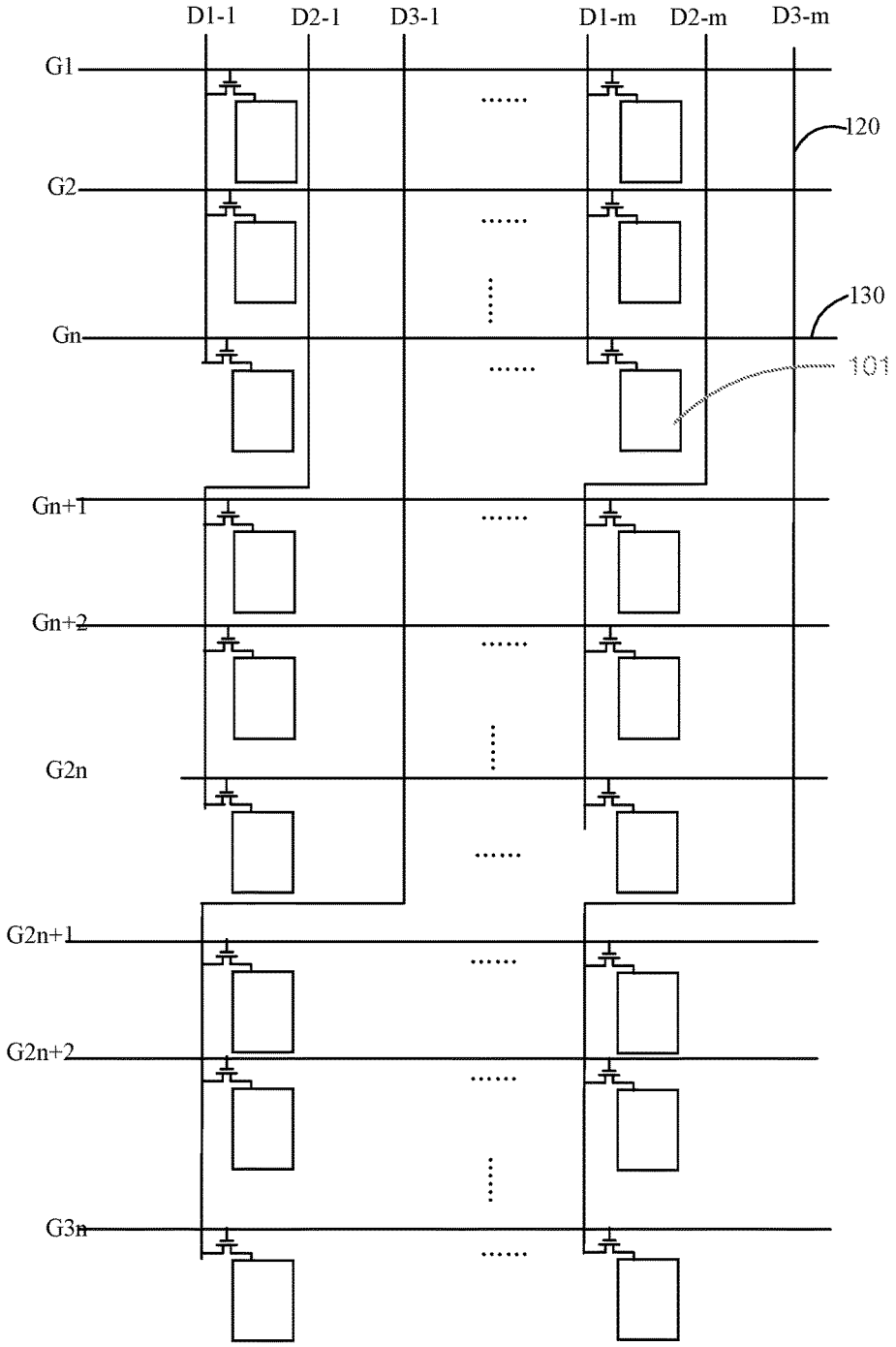
FIG. 5 is a schematic view showing the connection in the active area of the display panel of FIG. 4.

As shown in FIG. 5, FIG. 5 is a schematic view showing the connection in the active area of the display panel of FIG. 4.

Correspondingly, the active area 10*a* comprises a plurality of m*n pixel 101 arranged in an array, 3m data lines 120, and n scan lines 130, m and n are both natural numbers greater than 1. The plurality of data lines 120 extend along the first direction X and are arranged in parallel with each other with a predetermined distance apart and mutually insulated. The plurality of scan lines 130 extend along the second direction Y and are arranged in parallel with each other with a predetermined distance apart and mutually insulated. The plurality of scan lines 130 and the plurality of data liens 120 are mutually insulated.

The 3m data lines 120 are also divided into three sets, each set comprises m lines, and each set corresponds to an active area. Specifically, the three sets of the data lines 120 are defined as the first data line set 120*a*, a second data line set 120*b* and a third data line set 120*c*. For convenience of explanation, the data lines are denoted as D1-1, D1-2, . . . , D1-*m*; D2-1, D2-2, . . . , D2-*m*; D3-1, D3-2, . . . , D3-*m*, respectively.

Wherein, the first data line set D1-1, D1-2, . . . , D1-*m* is disposed correspondingly at the first active area AA1, and electrically connecting the first set of data outputs P1-1, . . . , P1-*m* to the pixels 101 respectively in the active area AA1. The second data line set D2-1, D2-2, . . . , D2-*m* is disposed correspondingly at the second active area AA2, and electrically connecting the second set of data outputs P2-1, . . . , P2-*m* to the pixels 101 respectively in the active area AA2. Apparently, the second data line set D2-1, D2-2, . . . , D2-*m* passes through the first active area AA1 insulated to extend to the second active area AA2 along the second direction Y, and the second data line set D2-1, D2-2, . . . , D2-*m* do not form electrical connection with any pixels 101 in the first active area AA1. The third data line set D3-1, D3-2, . . . , D3-*m* is disposed correspondingly at the third active area AA3, and electrically connecting the third set of data outputs P3-1, . . . , P3-*m* to the pixels 101 respectively in the active area AA3. Apparently, the third data line set D3-1, D3-2, . . . , D3-*m* passes through the first active area AA1 and the second active area AA2 insulated to extend to the third active area AA3 along the second direction Y, and the third data line set D3-1, D3-2, . . . , D3-*m* do not form electrical connection with any pixels 101 in the first active area AA1 and the second active area AA2.

Figure 6:
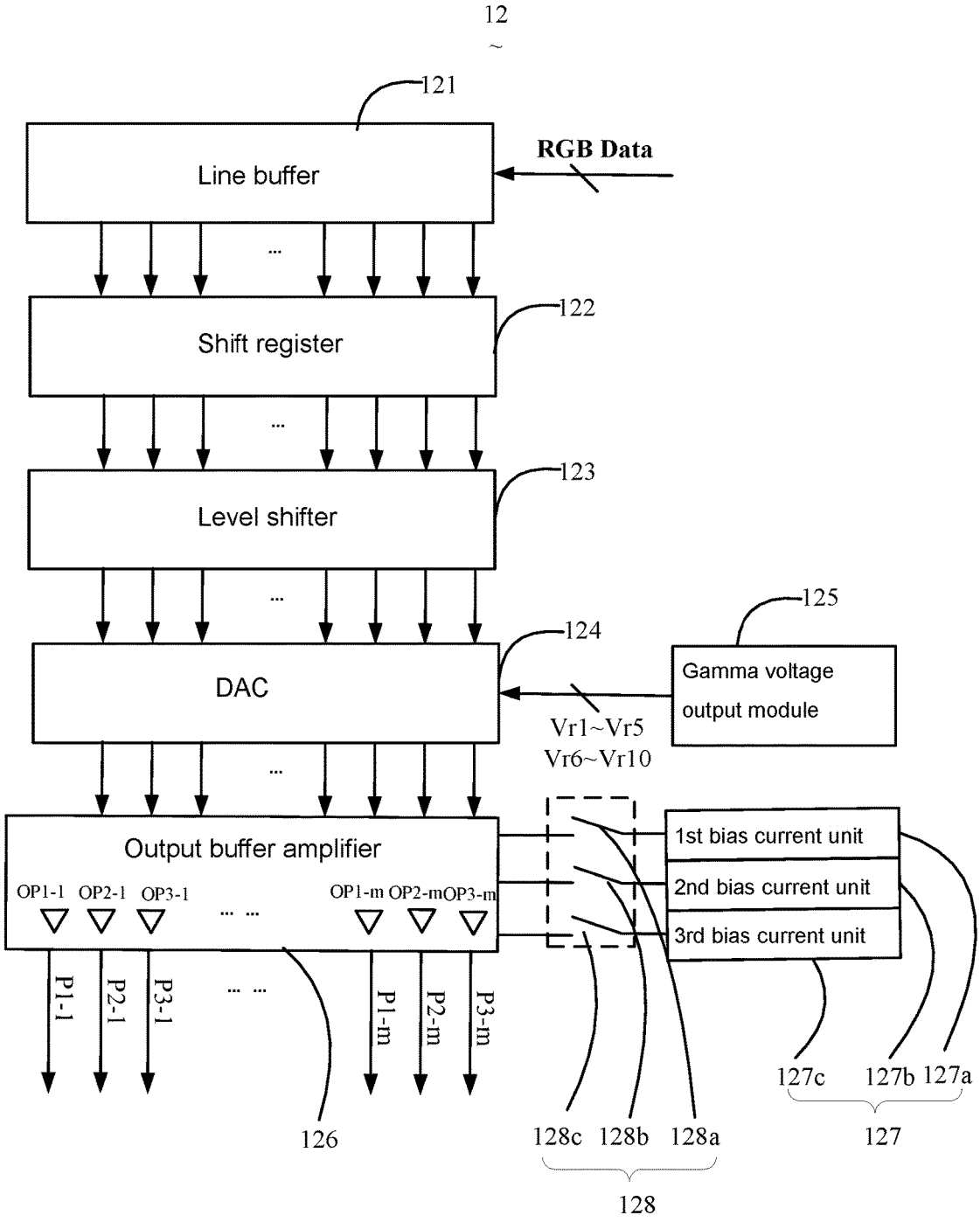
FIG. 6 is a schematic view showing the circuit block diagram of the data driver of FIG. 5.

Refer to FIG. 6. FIG. 6 is a schematic view showing the circuit block diagram of the data driver 12 of FIG. 5.

As shown in FIG. 6, the data driver 12 comprises a plurality of data outputs 121, and the plurality of data outputs 121 are divided into three sets, with each set comprises m data outputs. The three sets of data outputs 121 are denoted as P1-1, . . . , P1-*m*; P2-1, . . . , P2-*m*; P3-1, . . . , P3-*m*, respectively, and disposed with space apart. The data outputs in the adjacent three sets have the same data voltage; in other words, the arrangement order of the three sets of data outputs 121 is P1-1, P2-1, P3-1, P1-2, P2-2, P3-2, . . . , P1-*m*, P2-*m*, P3-*m*.

The data driver 12 further comprises: a line buffer 121, a shift register 122, a level shifter 123, a digital-to-analog converter (DAC) 124, a gamma voltage output module 125, an output buffer amplifier 126, and a bias current module 127. For explanation, the line buffer 121, shift register 122, level shifter 123, DAC 124, and gamma voltage output module 125 are used for processing inputted image signal, and are defined as a data processing unit; the output buffer amplifier 126 and bias current module 127 are used for enhancing the driving capability of the image signal, and are defined a driving unit.

Specifically, the line buffer 121 is for buffering the inputted image signal, and outputting the buffered image signal to the shift register 122. The image signal can be RGB video signal.

The shift register 122 is for shifting and locking the image signal outputted by the line buffer 121 under the control of horizontal synchronization signal, and transmitting the locked image signal to the level shifter 123.

The level shifter 123 is for enlarging the voltage of the image signal to activate the DAC 124.

The gamma voltage output module 125 is for outputting a plurality of continuous equal-duration reference voltage signals to the DAC 124, wherein the reference voltage signals comprise a gamma reference voltage signal, at least one of the reference voltage signals further comprising a low voltage signal having a voltage value less than a voltage value of the gamma reference voltage signal, wherein the duration of the reference voltage signal is equal to the duration of the existing gamma reference voltage signal.

The DAC 124 is for, after activation, converting the reference voltage signal to obtain corresponding analog voltage signal, and transmitting the analog voltage signal to the output buffer amplifier 126.

The output buffer amplifier 126 is for amplifying the analog voltage signal to enhance the driving capability to obtain a gray-scale voltage signal. The gray-scale voltage signal is the data signal, and the data signal is transmitted to the corresponding data outputs P1-1, . . . , P3-*m*. In the present embodiment, the output buffer amplifier 126 comprises a plurality of amplifiers OP, and the number of the amplifiers OP is the same as the number of the data output ends. Correspondingly, the plurality of amplifiers OP are also divided into three sets of amplifiers OP, denoted as the first set of amplifiers OP1-1, . . . , OP1-*m*; a second set of amplifiers OP2-1, . . . , OP2-*m*; and a third set of amplifiers OP3-1, . . . , OP3-*m*.

The bias current module 127 is electrically connected to the output buffer amplifier 126, for outputting a bias current to the output buffer amplifier 126 to control the amplification extent of the output buffer amplifier 126 on the analog voltage signal, i.e., controlling the driving capability of the data signal; wherein, the bias current serves as the driving current for the amplifier to control the driving capability of the data signal by the output buffer amplifier 126.

In the present embodiment, the bias current module 127 comprises three bias current units, and the three bias current units are defined as a first bias current unit 127*a*, a second bias current unit 127*b*, and a third bias current unit 127*c*; wherein the first bias current unit 127*a*, second bias current unit 127*b*, and third bias current unit 127*c* are electrically connected to the three sets of amplifiers respectively and output different bias currents to the three sets of amplifiers. Specifically, the first bias current unit 127*a* outputs a first bias current, the second bias current unit 127*b* outputs a second bias current, and the third bias current unit 127*c* outputs a third bias current; the second bias current is greater than the first bias current, and the third bias current is greater than the second bias current.

The first bias current is provided to the first set of amplifier OP1-1, . . . , OP1-*m*; the second bias current is provided to the second set of amplifier OP2-1, . . . , OP2-*m*; and the third bias current is provided to the third set of amplifier OP3-1, . . . , OP3-*m*. As a result, the amplification power of the first set of amplifier OP1-1, . . . , OP1-*m*, second set of amplifier OP2-1, . . . , OP2-*m*, and third set of amplifier OP3-1, . . . , OP3-*m* increases by that order.

Preferably, the bias current module 127 further comprises a switch unit 128, for controlling the bias current module 127 and output buffer amplifier 126 to conduct or cut off. The switch unit 128 correspondingly comprises three switches: a first switch 128*a*, a second switch 12*b*8 and a third switch 128*c*, respectively; wherein the first switch 128*a* is electrically connected to the first bias current unit 127*a* and the first set of amplifiers OP1-1, . . . , OP1-*m*; the second switch 128*b* is electrically connected to the second bias current unit 127*b* and the second set of amplifiers OP2-1, . . . , OP2-*m*; and the third switch 128*c* is electrically connected to the third bias current unit 127*c* and the third set of amplifiers OP3-1, . . . , OP3-*m*.

Figure 7:
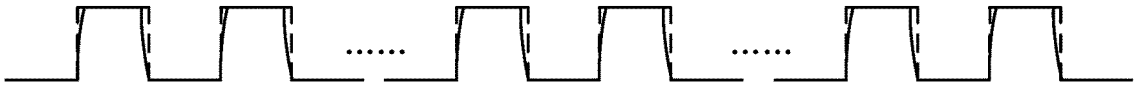
FIG. 7 is a schematic view showing the waveform of three adjacent data lines of FIG. 5 after loading in data voltage.

Specifically, refer to FIG. 7. FIG. 7 is a schematic view showing the waveform of three adjacent data lines of FIG. 5 after loading in data voltage.

Refer to FIGS. 5-7 simultaneously. When the data driver 12 operates, i.e., when the display panel 10 displays:

The first set of data outputs P1-1, . . . , P1-*m* receive the data voltage driven by the first bias current from the first set of amplifiers OP1-1, . . . , OP1-*m*, and output to the pixels 101 in the first active area AA1 distanced from the data driver 12 with the first distance L1;

The second set of data outputs P2-1, . . . , P2-*m* receive the data voltage driven by the second bias current from the second set of amplifiers OP2-1, . . . , OP2-*m*, and output to the pixels 101 in the second active area AA2 distanced from the data driver 12 with the second distance L2;

The third set of data outputs P3-1, . . . , P3-*m* receive the data voltage driven by the third bias current from the third set of amplifiers OP3-1, . . . , OP3-*m*, and output to the pixels 101 in the third active area AA3 distanced from the data driver 12 with the third distance L3.

Figure 8:
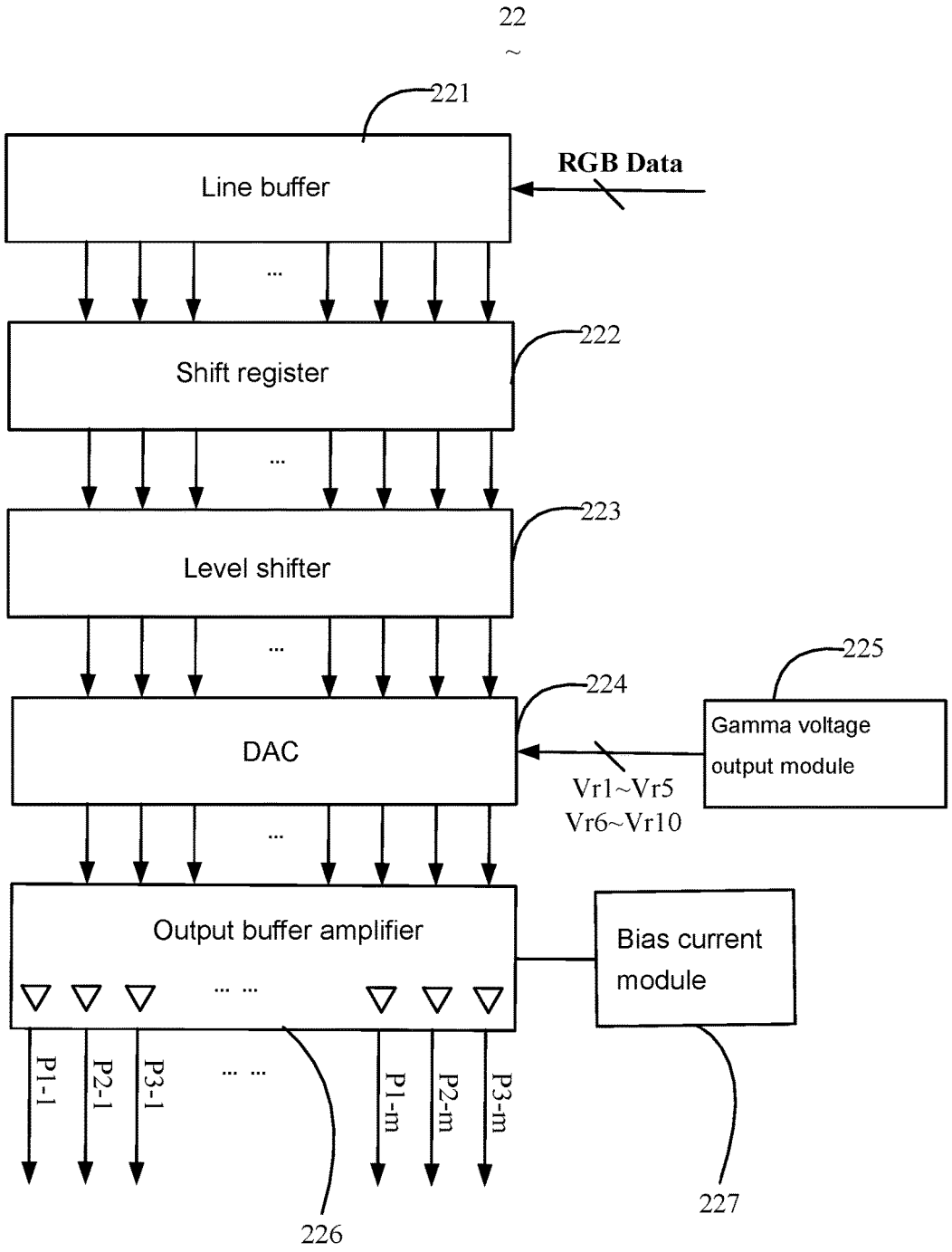
FIG. 8 is a schematic view showing the circuit block diagram of the data driver in an alternative embodiment of the present invention.

Accordingly, as shown in FIG. 8, although the first active area AA1, second active area AA2, and third active area AA3 have increasing distance from the data driver 12, the data voltages received by the first active area AA1, second active area AA2, and third active area AA3 are consistent due to the compensation on the effect of the RC circuit because of the increasingly enhanced driving capabilities of the data voltages outputted by the three sets of data outputs, so that the image data display is uniform for the entire active area 10*a*.

Alternatively, the active area 10*a* can be divided into a plurality of areas depending on the application, such as, two, four, five, or other number of areas.

Refer to FIG. 8. FIG. 8 is a schematic view showing the circuit block diagram of the data driver in an alternative embodiment of the present invention. The data driver 22 has a structure basically similar to the data driver 12, except that the bias current module 227 in the data driver 22 is linearly programmable. The bias current module 127, according to the first distance L1, second distance L2 and third distance L3 of the first active area AA1, second active area AA2 and third active area AA# from the data driver 22, changes the bias current correspondingly. In other words, the bias current module 127 outputs a bias current corresponding to the change trend of the effect by the RC circuit on the data voltage received by the pixels 101 in the active area 10*a*.

Figure 9:
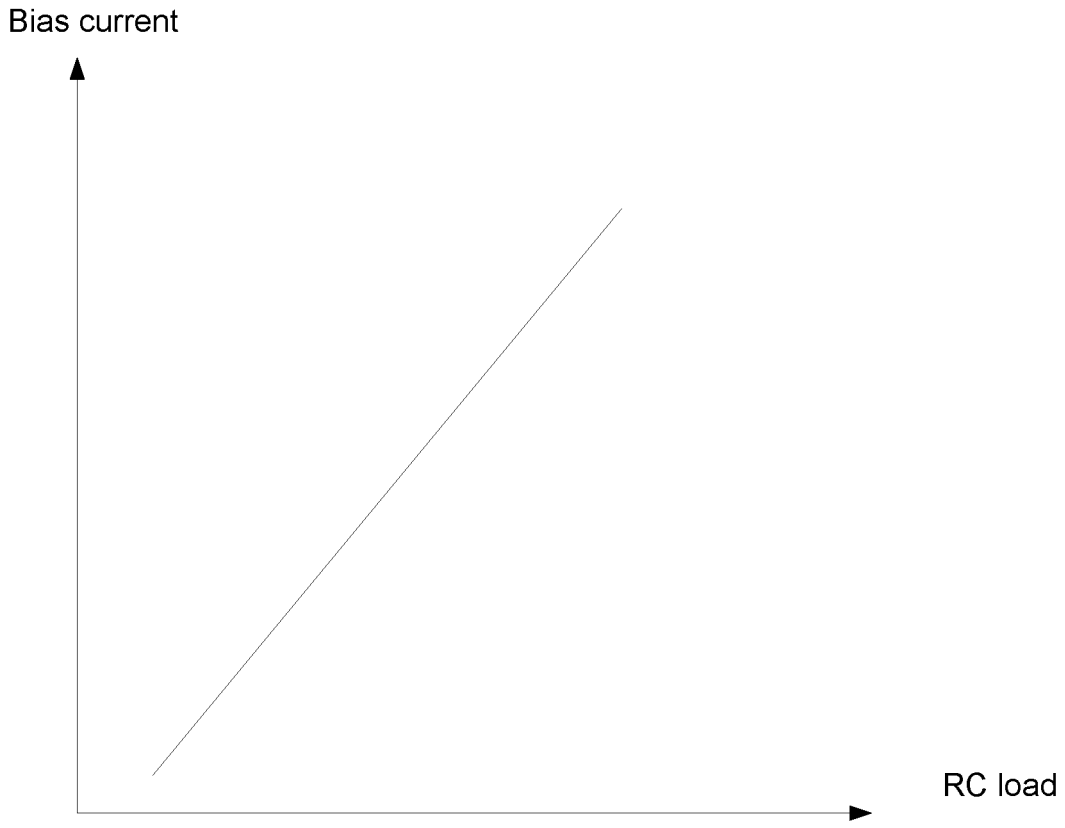
FIG. 9 is a schematic view showing the effect relation between the bias current outputted by the bias current module of FIG. 8 and the RC circuit of the data lines.

Specifically, as shown in FIG. 9, FIG. 9 is a schematic view showing the effect relation between the bias current outputted by the bias current module 227 of FIG. 8 and the RC circuit of the data lines. The horizontal axis indicates the equivalent RC load on any data line, and the vertical axis is the bias current outputted by the bias current module 227. It should be noted that the equivalent RC load on the data line can also be expressed as the distance between the data line and the data driver 12/22.

Therefore, the bias current outputted by the bias current module 227 has a linear relation with the effect by the RC circuit on the data voltage received by the pixels 101 of the active area. Because the bias current module 227 is a linear programmable module, the design of the bias current module 227 is simpler and easier to control.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A data driver, applicable to providing image data to be displayed to a plurality of data lines, comprising:

a data processing unit, configured to receive and store one frame of image data to be displayed;

a driving unit, for outputting at least two sets of data voltages having different driving capacities according to the image data; and at least two sets of data outputs, each of which corresponds to one of at least two areas of pixels, the at least two areas being arranged in sequence in a direction away from the data driver such that the at least two areas have different distances from the data driver, each of the at least two sets of data outputs comprising a plurality of data outputs, which are respectively connected to the pixels of one of the at least two areas corresponding thereto;

wherein the driving unit provides the at least two sets of data voltages having different driving capabilities to the at least two sets of data outputs, respectively, so that the at least two areas of pixels are each fed with one of the at least two sets of data voltages supplied through the one of the at least two sets of data outputs corresponding thereto, and the at least two areas of pixels in the same column are each connected to a different data line, and each data line is connected to multiple pixels in corresponding areas of pixels; and wherein the pixels of each of the at least two areas are arranged in sequence away from the data driver and the pixels of the at least two areas are arranged, collectively, in sequence away from the data driver, such that the at least two areas of pixels are respectively fed with the at least two sets of data voltages having different driving capacities in such a sequence that the at least two areas are arranged away from the data driver and the pixels of each of the at least two areas are fed with the one of the at least two sets of data voltages corresponding thereto in such a sequence that the pixels are arranged away from the data drivers, the pixels of the at least two areas in combination being respectively fed with the at least two sets of data voltages having different driving capacities in such a sequence that the pixels of the two areas are arranged away from the data driver;

wherein the driving unit comprises:

at least two sets of output amplifier units, with each set comprising a plurality of amplifiers, each amplifier corresponding to a data output, and the amplifier being for amplifying the driving capability of the image data;

at least two bias current units, the at least two bias current units electrically connected respectively to the at least two sets of output amplifier units, for outputting different bias currents respectively to the corresponding set of output amplifier units to control amplification extent of the corresponding set of output amplifier units to output corresponding sets of data outputs;

wherein the bias current provided to the corresponding set of output amplifier unit connected to the pixels with a longer distance from the data driver is greater than the bias current provided to the corresponding set of output amplifier unit connected to the pixels with a shorter distance from the data driver.

2. The data driver as claimed in claim 1, wherein the bias current is used as driving current of the amplifier.

3. The data driver as claimed in claim 2, wherein the driving unit comprises a switch unit, for controlling conduction or cut-off of the bias current module and the output buffer amplifier, the switch unit comprises a first switch, a second switch, and a third switch; the first switch is electrically connected to the first bias current unit and the first set of amplifier unit; the second switch is electrically connected to the second bias current unit and the second set of amplifier unit; the third switch is electrically connected to the third bias current unit and the third set of amplifier unit.

4. The data driver as claimed in claim 1, wherein the at least two bias current units comprise a first bias current unit, a second bias current unit and a third bias current unit; the at least two sets of data outputs comprise a first set of data outputs, a second set of data outputs, and a third set of data outputs; the first set of data outputs provide data voltages to the pixels separated from the data driver with a first distance; the second set of data outputs provide data voltages to the pixels separated from the data driver with a second distance; the third set of data outputs provide data voltages to the pixels separated from the data driver with a third distance; the first distance, second distance and third distance are in increasing order; the first bias current unit outputs a first bias current to the first set of data outputs; the second bias current unit outputs a second bias current to the second set of data outputs; the third bias current unit outputs a third bias current to the third set of data outputs; the first bias current, second bias current and third bias current are in increasing order.

5. The data driver as claimed in claim 4, wherein the first bias current, second bias current and third bias current have a positive proportional linear relation with the first distance, second distance and third distance.

6. The data driver as claimed in claim 1, wherein the driving unit comprises: at least two sets of output amplifier units, with each set comprising a plurality of amplifiers, each amplifier corresponding to a data output, and the amplifier being for amplifying the driving capability of the image data; a programmable bias current unit, electrically connected to the at least two sets of output amplifier units, for outputting a different bias current to the output amplifier unit in accordance with the distance of the pixel separated from the data driver, and the bias current gradually increases as the distance from the data driver increases.

7. The data driver as claimed in claim 6, wherein the bias current has a positive proportional linear relation with the distance of the pixels from the data driver.

8. The data driver as claimed in claim 1, wherein the data processing unit comprises: a line buffer, a shift register, a level shifter, a digital-to-analog converter (DAC), and a gamma voltage output module; the line buffer is for buffering an inputted image signal, and outputting the buffered image signal to the shift register; the shift register is for shifting and locking the image signal outputted by the line buffer and transmitting the locked image signal to the level shifter; the level shifter is for enlarging the voltage of the image signal to activate the DAC; the gamma voltage output module is for outputting a reference voltage signal to the DAC; and the DAC is for, after activation, converting the reference voltage signal to obtain corresponding analog voltage signal.

9. A display panel, comprising: an active area, extending in a plane along mutually perpendicular first and second directions, and the active area defining at least two active sub-areas in the second direction; a plurality of data lines arranged with a distance apart along the first direction, the data lines extending along the second direction and disposed independently at the at least two active sub-areas; and a data driver as claimed in claim 1, disposed at one end of the data lines in the second direction for providing a data voltage for image display for the data lines, wherein the at least two active sub-areas of the active area respectively correspond to at least two areas of pixels and the at least two active sub-areas and the data driver being are spaced apart with the different distances.

10. The display panel as claimed in claim 9, wherein the driving unit comprises: at least two sets of output amplifier units, with each set comprising a plurality of amplifiers, each amplifier corresponding to a data output, and the amplifier being for amplifying the driving capability of the image data; at least two bias current unit, the at least two bias current units electrically connected respectively to the at least two sets of output amplifier units, for outputting different bias currents respectively to the corresponding set of output amplifier units to control amplification extent of the corresponding set of output amplifier units; wherein, the bias current provided to the corresponding set of output amplifier unit connected to the pixels having a larger distance from the data driver being greater than the bias current provided to the corresponding set of output amplifier unit connected to the pixels having a smaller distance from the data driver.

11. The display panel as claimed in claim 10, wherein the bias current is used as driving current of the amplifier.

12. The display panel as claimed in claim 10, wherein the at least two bias current units comprise a first bias current unit, a second bias current unit and a third bias current unit; the at least two sets of data outputs comprise a first set of data outputs, a second set of data outputs, and a third set of data outputs; the first set of data outputs provide data voltages to the pixels separated from the data driver with a first distance; the second set of data outputs provide data voltages to the pixels separated from the data driver with a second distance; the third set of data outputs provide data voltages to the pixels separated from the data driver with a third distance; the first distance, second distance and third distance are in increasing order; the first bias current unit outputs a first bias current to the first set of data outputs; the second bias current unit outputs a second bias current to the second set of data outputs; the third bias current unit outputs a third bias current to the third set of data outputs; the first bias current, second bias current and third bias current are in increasing order.

13. The display panel as claimed in claim 12, wherein the first bias current, second bias current and third bias current have a positive proportional linear relation with the first distance, second distance and third distance.

14. The display panel as claimed in claim 10, wherein the driving unit comprises: at least two sets of output amplifier units, with each set comprising a plurality of amplifiers, each amplifier corresponding to a data output, and the amplifier being for amplifying the driving capability of the image data; a programmable bias current unit, electrically connected to the at least two sets of output amplifier units, for outputting a different bias current to the output amplifier unit in accordance with the distance of the pixel separated from the data driver, and the bias current gradually increases as the distance from the data driver increases.

15. The display panel as claimed in claim 14, wherein the bias current has a positive proportional linear relation with the distance of the pixels from the data driver.

* * * * *